United States Patent [19]

Hukuba

[11] 4,220,985

[45] Sep. 2, 1980

[54] ILLUMINATION DEVICE

[76] Inventor: Hiroshi Hukuba, No. 914-1, Nazukari, Nagareyama-shi, Chiba-ken, Japan

[21] Appl. No.: 8,273

[22] Filed: Feb. 1, 1979

[30] Foreign Application Priority Data

Feb. 3, 1978 [JP] Japan ..... 53-10556
Oct. 31, 1978 [JP] Japan ..... 53-134110

[51] Int. Cl.[3] ..... F21L 7/00
[52] U.S. Cl. ..... 362/203; 362/205
[58] Field of Search ..... 362/202, 203, 205, 206

[56] References Cited

U.S. PATENT DOCUMENTS 2,852,662 9/1958 Garland ..... 362/205
3,835,272 9/1974 Wisenbaker ..... 362/206 X

*Primary Examiner*—Stephen J. Lechert, Jr.
*Attorney, Agent, or Firm*—Blanchard, Flynn, Thiel, Boutell & Tanis

[57] ABSTRACT

The illumination device comprises a body, an illumination means, a holding means and a switching means, the last mentioned three means being attached to said body. Said holding means includes a battery and a biasing means made of an electrically conductive material. The holding means is made of an electrically conductive material and is constantly electrically connected to one electrode of said battery through said biasing means. The biasing means is designed to function so as to keep the other electrode of the battery in the state of being constantly electrically connected to one terminal of said illumination means while keeping, in a steady state, the holding means in the state of being removed from the other terminal of the illumination means. Said switching means is movable relative to said body and is designed to displace, by its movement, said holding means in the direction of its axis against the biasing force of said biasing means, thereby permitting the holding means to be electrically connected to the other terminal of said illumination means.

15 Claims, 13 Drawing Figures

ILLUMINATION DEVICE

BACKGROUND OF THE INVENTION

The present invention relates to an illumination device, in particular one in which a body is provided with an illumination means, a holding means including therein a battery and a biasing means, and a switching means.

Devices of this type are widely seen in portable illumination devices, for instance, such as pocket lights, pen-like lights and the like. Therefore, various kinds of different switching mechanisms have already been proposed in the conventional devices of this type.

In the conventional devices, however, there can be found no mechanism in which the ON and OFF conditions of an illumination means are achieved by movement of a holding means in the direction of its axis. The switching mechanism of this type, however, is advantageous particularly in case the device is made to have a water proof structure. In other words, since the function of the switching means is only to move the holding means by a short distance in the direction of its axis, if the body is cylindrically shaped so as to include therein the holding means, it will be very easy to dispose a sealing means of a simple structure at the desired position. Especially when the switching means is disposed at one side of the holding means, the other side of which is related to the illumination means, an O-ring can be used effectively by attaching it to the switching means for sealing between the inside face of the body and the outside face of the switching means.

The switching mechanism like this, even if the device is made to have a water proof structure, is also advantageous in that the handling is simple and the operation is ensured. In other words, a second biasing means can be disposed between the switching means and the holding means. Moreover, the switching means can be provided with a stop means to stop the extending end of the second biasing means so as to maintain at a fixed length the length of the second biasing means in an extended state over the switching means.

SUMMARY OF THE INVENTION

One object of the present invention is to provide an illumination device having a novel structure wherein the ON and OFF conditions of an illumination means are effected by the movement of a holding means in the direction of its axis, said holding means being provided in a body together with the illumination means and a switching means.

Another object of the present invention is to provide an illumination device wherein a cylindrical body, a cover portion of an illumination means and a switching means are all made of water proofing materials so that they can have a superior water resisting property and thus can be applicable to universal use.

A further object of the present invention is to provide an illumination device wherein a switching means is disposed at one side of a holding means, the other side of which is related to an illumination means, thereby simplifying the structure and disposition of a sealing means.

A still further object of the present invention is to provide an illumination device wherein a second biasing means is disposed between a switching means and a holding means, whereby the handling of the switching means is simplified and even when a serious irregularity exists with respect of the length of a battery and/or the length of an illumination means, etc., the ON and OFF operations may be ensured.

Another object of the present invention is to provide an illumination device wherein a switching means is provided with a stop means to stop the extending end of a second biasing means so as to maintain at a fixed length the extending length of the second biasing means in prolonged state over the switching means, whereby even when serious irregularity exists with respect of the length and/or characteristic of the second biasing means, the ON and OFF operations may be ensured.

Another object of the present invention is to provide an illumination device wherein both terminals of an illumination means and a holding means, which are electrically connected with or disconnected from each other, are each formed as a rigid body being substantially freed from deformation to be caused by the ON and OFF operations, whereby the electrical contact portions are easy to manufacture and the quality is stable.

BRIEF DESCRIPTION OF THE DRAWING

FIG. 1 is a front elevational view illustrating the switch-off condition of the illumination device;

FIG. 2 is a vertical sectional view taken along the line II—II of FIG. 1;

FIG. 3 is a vertical sectional view similar to FIG. 2 and illustrating the switch-on condition of the illumination device;

FIG. 4 is a vertical sectional view of the main portion of the illumination device taken along the line IV—IV of FIG. 2; and FIG. 5 is a horizontal sectional view taken along the line V—V of FIG. 4.

FIG. 6 is a vertical sectional view illustrating the switch-off condition of the illumination device;

FIG. 7 is a vertical sectional view similar to FIG. 6 and illustrating the switch-on condition of the illumination device;

FIG. 8 is an enlarged vertical sectional view of the main portion of the illumination device taken along the line VIII—VIII of FIG. 6; and FIG. 9 is a horizontal sectional view of the main portion of the illumination device taken along the line IX—IX of FIG. 6.

FIG. 10 is a vertical sectional view of the inspection device for organic cavities;

FIG. 11 is a horizontal sectional view taken along the line XI—XI of FIG. 10; and FIG. 12 is an enlarged rear view of the inspection or object mirror portion of the inspection device for organic cavities.

DETAILED DESCRIPTION OF THE INVENTION

Figure 1:
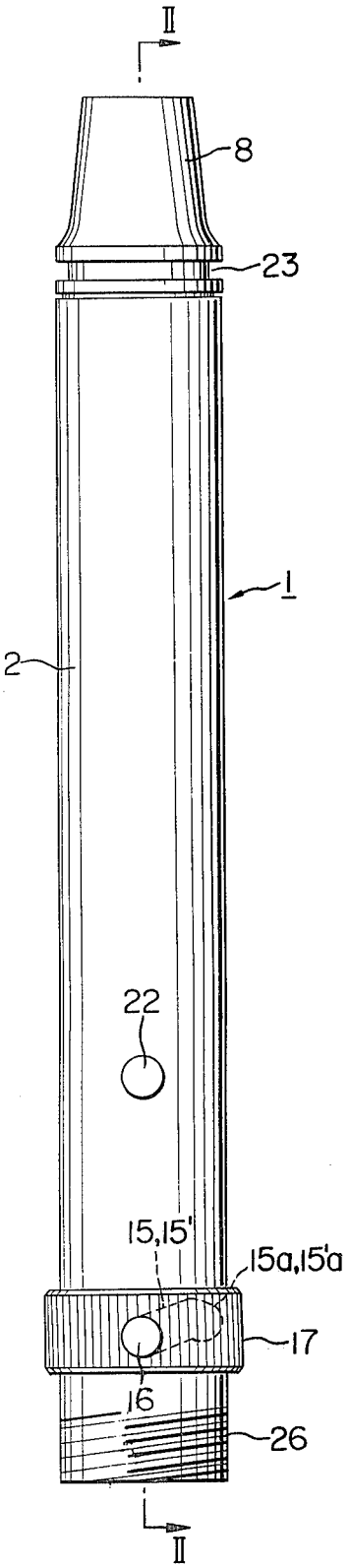
FIGS. 1–5 are views of a first embodiment of an illumination device according to the present invention suitably constructed for application to inspection devices for organic cavities.
Figure 2:
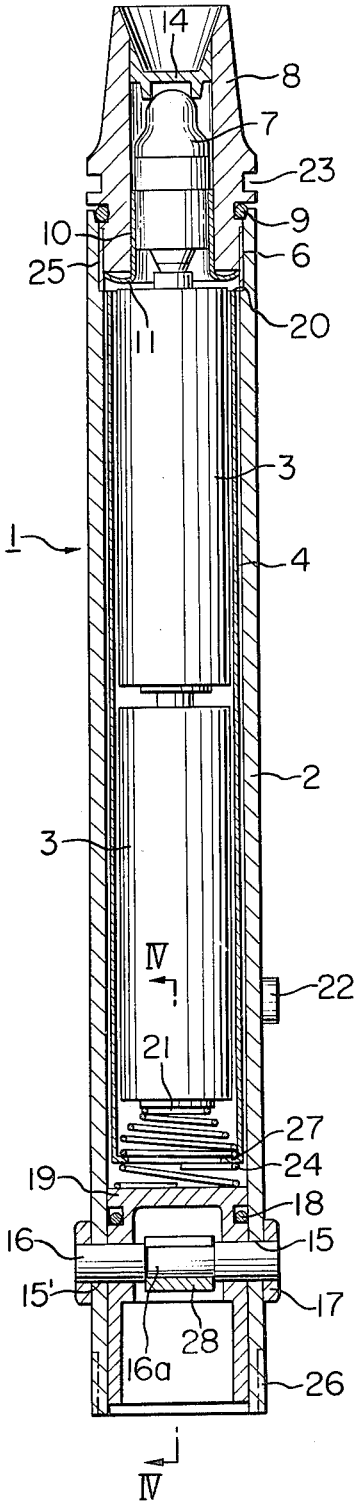
Figure 3:
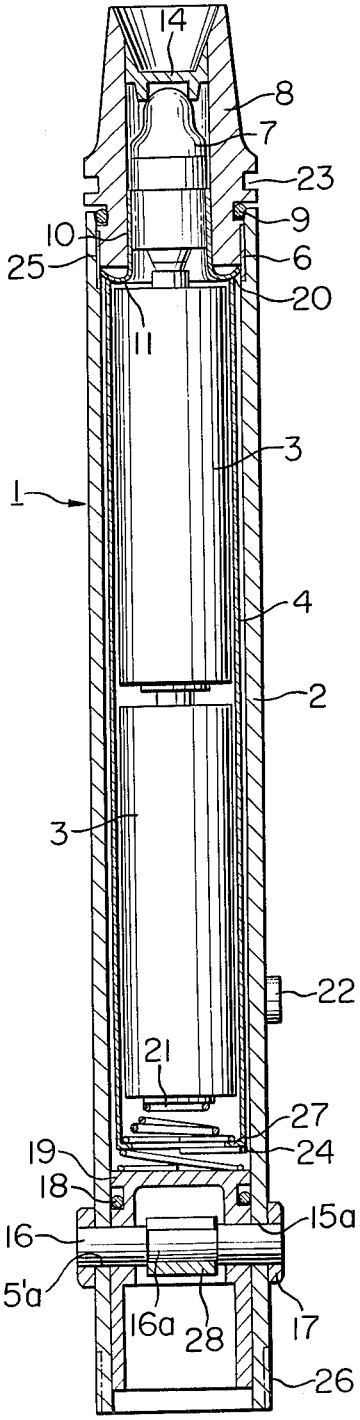
Figure 4:
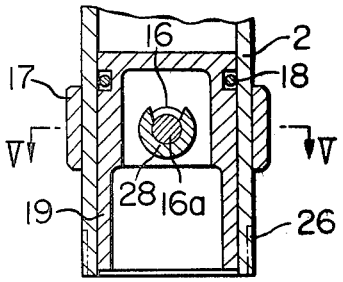
Figure 5:
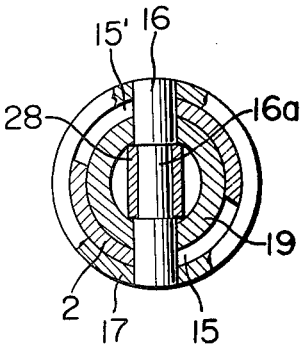

In FIGS. 1–5 there is shown the first embodiment of the illumination device according to the present invention. An illumination device 1 is provided with a cylindrical body 2 including therein an inner cylinder 4, which contains a battery 3 and is made of an electrically conductive material such as aluminum or the like. The body 2 is made of a water proofing and electrically non-conductive material. On the top inner peripheral face of the body 2 is formed a screw-threaded portion 6. To the screw-threaded portion 6 is screw fitted a screw-threaded portion 25 which is formed on the outer peripheral face of a cover 8 having a lamp 7 which is connected with the battery 3. Between the body 2 and the cover 8 there is disposed an O-ring 9 made of rubber whose surface has been processed with halogen or the like material. The lamp 7 is attached to the cover 8 by a terminal ring 10 made of an electrically conductive material such as aluminum, brass or the like. The lower portion of this terminal ring 10 is bent outwardly to form a flange 11. The top center portion 14 of the cover 8 is made of a transparent material and the remainder thereof is made of an opaque material.

The body 2 covers the entire length of the inner cylinder 4, and is designed to be used as a handle. In the vicinity of the base portion of the body 2 there are provided, opposed slots 15 and 15′ which are inclined relative to both the circumferential direction and the axial direction of the body 2. A rod 16 passes through the slots 15 and 15′. To the rod 16 are respectively attached, an operation ring 17 located outside of the body 2 and adapted for operating the switch and a switching cylinder 19 located inside of the body 2. On the outer peripheral surface of the switching cylinder 19 there is formed a groove in which is fitted an O-ring 18 made of rubber whose surface has been processed with halogen or the like. The switching cylinder 19 is designed to move axially when the operation ring 17 is moved in the circumferential direction. On the upper edges of slots 15 and 15′ are formed stop portions 15*a* and 15′*a* which are substantially parallel to the circumferential direction of the body 2, preferably a little inclined opposite to the inclined direction of the remaining portions of said slots relative to said circumferential direction. Further, an engaging strip 28 is fitted on a small diameter portion 16*a* formed on the intermediate portion of the rod 16, whereby the rod 16 is located at a fixed position. Like the cover 8, the rod 16, the operation ring 17 and the switching cylinder 19 are made of a water proofing as well as electrically non-conductive material, respectively.

On the bottom edge of the inner cylinder 4 there is formed a flange 27 extending inwardly from the circumferential surface, and between this flange 27 and the battery 3 contained therein is disposed a spring 21 made of electrically conductive material which is designed to constantly electrically connect the inner cylinder 4 to the lower electrode of the battery 3 and to bias the battery 3 toward the top end so as to constantly electrically connect the upper electrode of the battery 3 with the center terminal of the lamp 7 and further to separate the annular top edge 20 of the inner cylinder 4 from the annular flange 11 which constitutes the circumferential terminal for the lamp 7. A spring 24 is also disposed between the switching cylinder 19 and the flange 27 of the inner cylinder 4. The power of the spring 24 is greater than that of the spring 21 and, in more detail, it is sufficient to ensure the upward movement of the inner cylinder 4 with the upward movement of the switching cylinder 19, thereby electrically connecting the annular top edge 20 of the inner cylinder 4 to the flange 11 of the terminal ring 10 when the rod 16 reaches a position somewhat short of the stop portions 15*a* and 15′*a*, and further sufficient to be shortened with the movement of the switching cylinder 19 until the rod 16 is fitted in the stop portions 15*a* and 15′*a*, thereby ensuring said electrical connection.

This illumination device 1 is provided with a stopper projection 22, an annular groove 23 and a screw-threaded portion 26 so that it may be suitably applicable to inspection device for organic cavities, but they may be omitted depending on the use. Further, the up-and-down movement of the switching cylinder 19 may be done without relying on the above mentioned structure and, in more detail, by providing an operating member mounted on the bottom portion of the body 2 so as to rotate only along the circumferential direction of the body or mounted on the bottom portion of the body 2 so as to move only along the direction of axis thereof, for instance, such as an operating member of push button type as seen in a ball-point pen or the like. Still further, it is not always necessary for the inner cylinder 4 to be shaped cylindrically as in the body 2, but clearly any shape can be employed which will allow the inner cylinder to hold the battery 3 and move therewith in the axial direction.

Hereinafter, reference will be made to the function of the illumination device of the present invention. By rotating the operation ring 17 in one direction relative to the body 2, the switching cylinder 19 is moved upwardly from the switch-off position shown in FIGS. 1 and 2 where the rod 16 is positioned in the lower ends of slots 15 and 15′ to the switch-on position indicated in FIG. 3 where the rod 16 is fitted in the stop portions 15*a* and 15′*a* formed on the upper edges of slots 15 and 15′ and the inner cylinder 4 thus is moved upwardly so as to light the lamp 7. By rotating the operation ring 17 in the direction opposite to the above mentioned direction, the rod 16 is disengaged from the stop portions 15*a* and 15′*a* and allowed to move toward the lower ends of slots 15 and 15′, and the switching cylinder 19 and the inner cylinder 4 thus move downward so as to put out the lamp 7.

Furthermore, replacement of the battery 3 can be effected by removing the cover 8 from the body 2, taking the battery 3 and the inner cylinder 4 out of the body 2 for the purpose of replacing the battery, then inserting in the body 2 the inner cylinder 4 in which a fresh battery 3 was charged, and screw tightening the cover 8.

The illumination device 1, therefore, can be used without trouble for a long period of time because moisture does not permeate thereinto even when it is used or stored in a humid atmosphere or the outside thereof is washed with water.

In FIGS. 6–9 there is shown a second embodiment of the illumination device according to the present invention, and this illumination device is only partially different from the above mentioned first embodiment. Therefore, the same reference numerals will be applied to like parts, and the following explanation will be directed to the parts that are different from the first embodiment.

Figure 6:
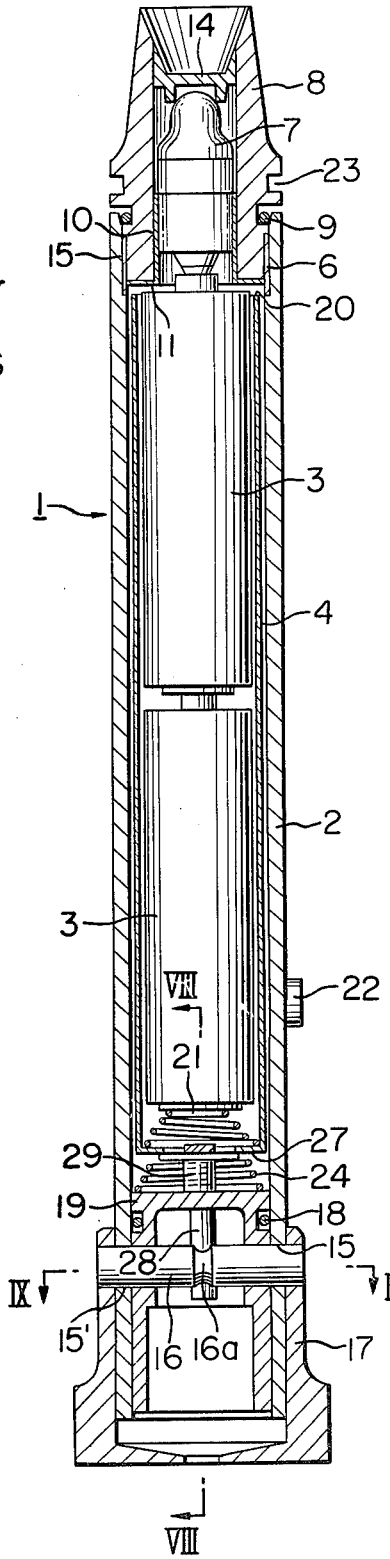
FIGS. 6–9 are views of a second embodiment of the illumination device according to the present invention suitably constructed for application to inspection devices for organic cavities.
Figure 7:
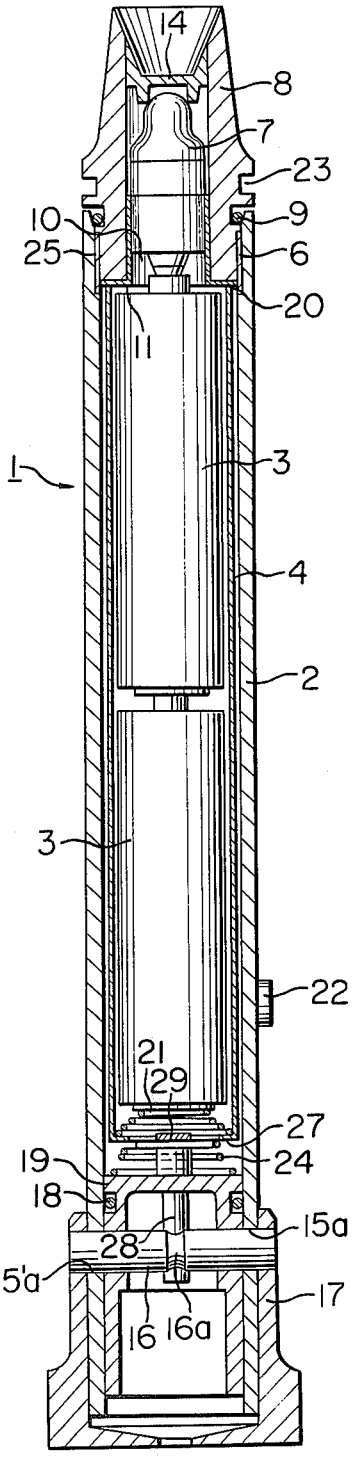
Figure 8:
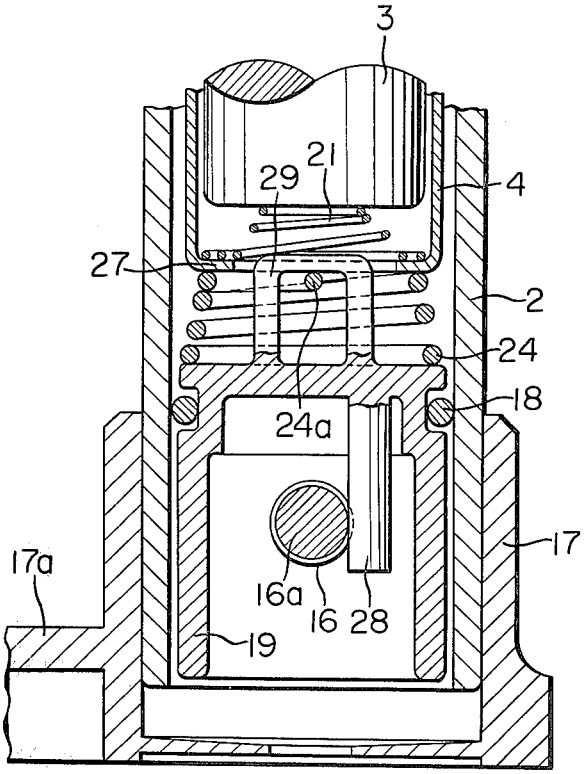
Figure 9:
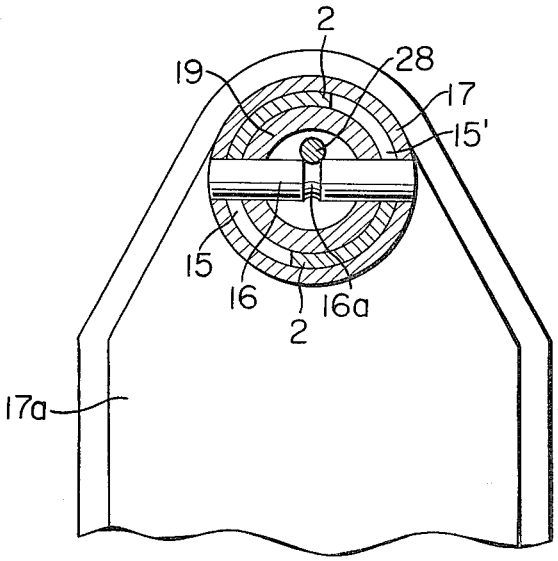

As is clearly shown in FIG. 8, at the upper portion of the switching cylinder 19 there is formed integrally an upwardly extending stop member 29. The stop member 29 functions to put the extended edge 24*a* of the spring 24 in position for the purpose of maintaining the height of spring 24 in a prolonged condition at a fixed height. Once the spring 24 has been positioned between the switching cylinder 19 and the stop member 29, considerable irregularities in height and strength inherent thereto at the time of production may be made substantially negligible by the action of the stop member 29, whereby the ON and OFF operations are ensured. The stop member 29, as shown in FIGS. 6 and 7, is constructed to have a considerable width lest the spring 24, which was made conical so as to vary the height in a wide range, should incline at the top surface.

The flange 11 of the terminal ring 10 connects, in this case, with the lower surface of the cover 8, and accordingly the flange 11 and the upper end of the inner cylinder 4 constituting the switching contacts are each made of a rigid body which is not subjected to deformation to be caused by the ON and OFF operations. An engaging strip 28 extends in this case from the upper portion of the switching cylinder 19 through the inside thereof downwardly so as to fit on the small diameter portion 16*a* of the rod 16. And the operation ring 17 in this case extends over the bottom portion of the body 2, and further a horizontal portion 17*a* is formed so as to hold the body upright as illustrated.

As the function of this illumination device 1 is substantially identical with that of the above first embodiment, explanation thereon will be omitted.

Figure 11:
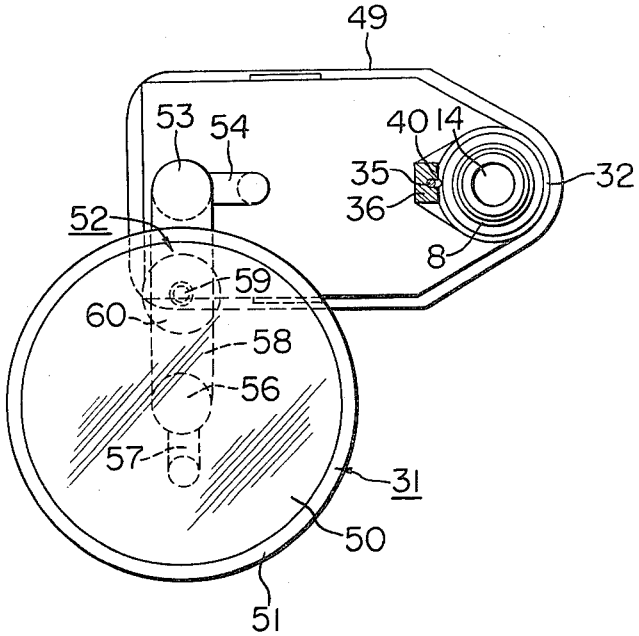
FIGS. 10–12 are views illustrating one embodiment of the inspection device for organic cavities to which the above mentioned first embodiment of the illumination device according to the present invention is applied.
Figure 10:
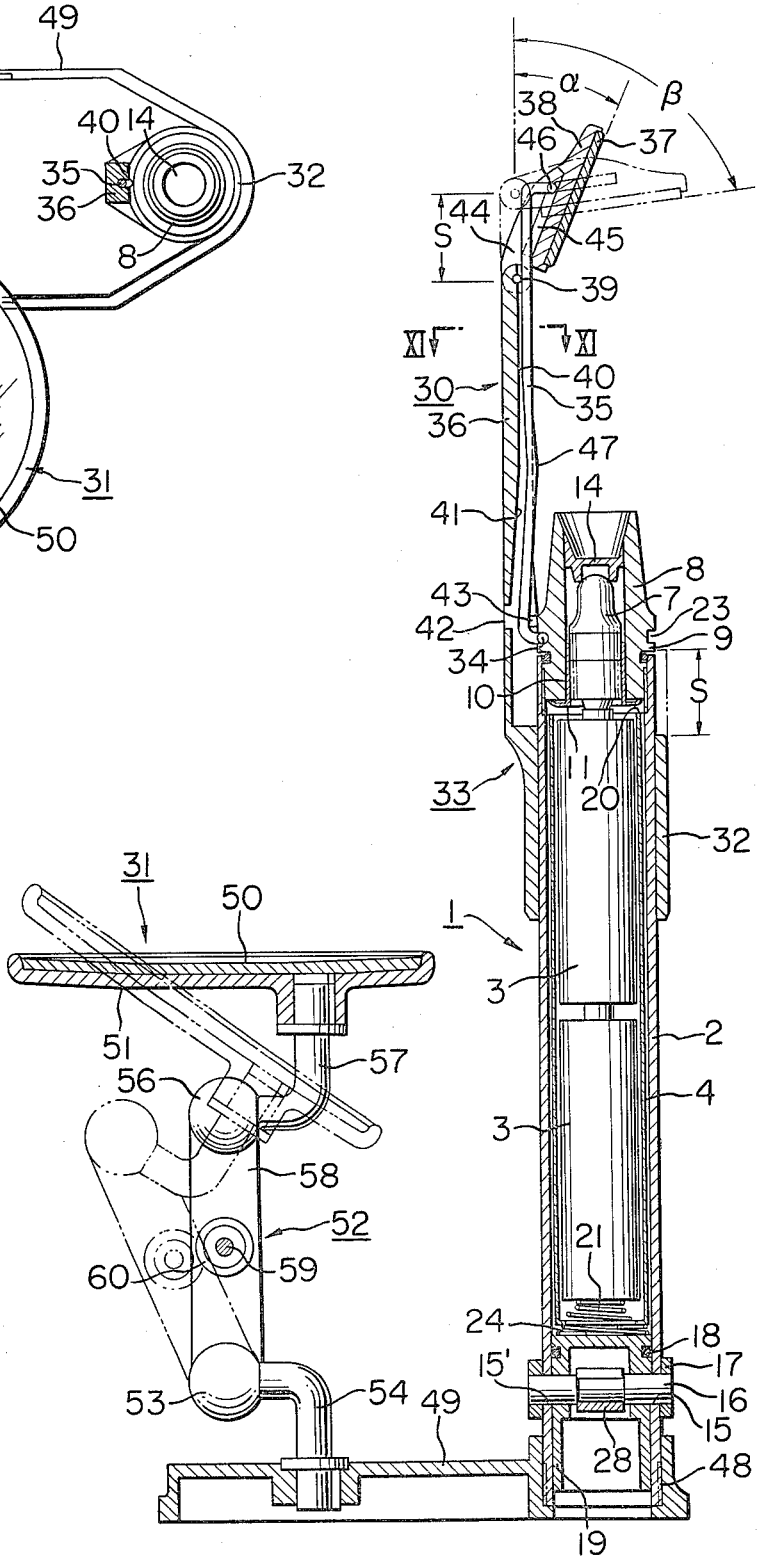
Figure 12:
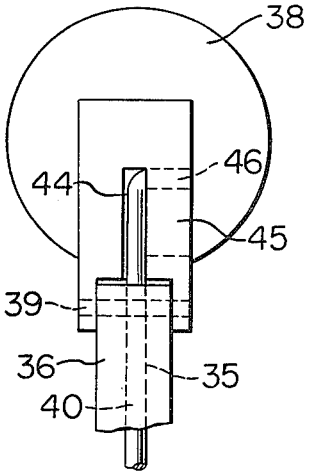

Next, explanation will be made about one embodiment of the inspection device for organic cavities employing the first embodiment of the illumination device according to the present invention with reference to FIGS. 10–12.

This inspection device for organic cavities comprises an illumination device 1, an inspection mirror member or object mirror member 30, and an ocular mirror member 31. The inspection mirror member or object mirror member 30 is composed of a post member 33 having an operating sleeve 32 which is devised to be slidably fitted on the body 2 in detachable fashion and a rod 35 having a rod end 34 which is devised to be guided by said post member 33 and fit in the annular groove 23 of the body 2 in detachable fashion.

On the post member 33 is formed a post 36 having a fixed length which extends upwardly from the side of the operating sleeve 32, and on the upper end of said post 36 is installed an inspection mirror or object mirror holder 38 holding an inspection mirror or object mirror 37 by means of a pin 39 so as to be capable of tilting around said pin 39. The operating sleeve 32 is so devised as to be rotatable around the body 2 when slidably engaged therewith and slidable in the direction of its axis. Besides, this sleeve 32 is devised to fit in the body 2 in slidable fashion while retaining an appropriate friction force in relation to the body 2 so that it can stand still at an optional position. This friction force can be obtained from the reaction force of the rod end 34 against the annular groove 23 as well as from the dimensional co-relation between the bore of the operating sleeve 32 and the outer diameter of the body 2.

Preferably, the lower half of the outer wall of the operating sleeve 32 is provided with a surface which is not smooth in order to facilitate the operation at the time of rotating the operating sleeve 32 or tilting it in the direction of its axis. On the inner wall of the post 36 is formed a guide groove 40 which extends lengthwise from the upper end positioned inside the pin 39. This guide groove 40 is so formed that its depth gradually increases from about the middle of the length of the post 36 toward the lower part thereof to become an inclined groove 41, and near that base of the post 36 disposed further below, it becomes a perforation 42 which penetrates the inner and outer walls of the post 36. On the post 36 are further provided a pair of projections 43 facing each other which are disposed near the lower part of said inclined groove 41 for the purpose of holding a rod 35 within the guide groove 40 lest it should slip out of the guide groove 40 at the time when the inspection mirror member or object mirror member 30 is in the state of having been demounted from the body 2. On the back of the inspection mirror or object mirror holder 38 are formed a longitudinal groove 44 and an engaging groove 45.

On the end of the rod 35 opposite to said rod end 34 is formed a rod slide 46 which extends parallel to the pin 39, and this rod slide 46 is inserted in the engaging groove 45 of the inspection mirror or object mirror holder 38 and engages with said groove. The middle part of the rod 35 extending from the rod slide 46 to the rod end 34 is accomodated in the longitudinal groove 44, guide groove 40 and inclined groove 41, whereby the rod 35 is incorporated into the post member 33. The middle part of the rod 35 accomodated in the guide groove 40 is curved and extends outwardly over the upper edge of the guide groove 40. And this projected portion 47 is pressed towards the guide groove 40 so that the rod end 34 may be disengaged from the annular groove 23.

The inspection mirror member or object mirror member 30 as described above is to be used in the state of being installed on the body 2 in the following way. The operating sleeve 32 is slidably engaged with the body 2, and the rod end 34 is fitted in the annular groove 23. At this time, the operating sleeve 32 is capable of rotating round the body 2 and is also capable of tilting in the direction of its axis. And the rod end 34 does not move in the direction of axis of the body 2, but is capable of rotating round the body 2. When the operating sleeve 32 in this state is pulled down to the full, the rod end 34, as shown in FIG. 10, is raised up just below the projection 43 and the rod slide 46 comes to be positioned at the right end of the engaging groove 45, whereby the angle of tilting of the inspection mirror or object mirror 37 becomes the minimum $\alpha$. On the contrary, when the operating sleeve 32 is pulled upwards to the full, the rod end 34 goes down far away from the projection 43 and the rod slide 46 comes to be positioned at the left end of the engaging groove 45, whereby the angle of tilting of the inspection mirror or object mirror 37 becomes the maximum $\beta$. The vertical stroke of the operating sleeve 32 required for tilting the inspection mirror or object mirror 37 in a mouth within the range of from $\alpha$ to $\beta$ is indicated by S.

The inspection mirror member or object mirror member 30, when out of use, is devised to be capable of shortening the length extending from upper end thereof to the lower end of the body 2 in the following manner. In more detail, the projected portion 47 of the rod 35 is pressed towards the guide groove 40 to thereby disengage the rod end 34 from the annular groove 23 and then the operating sleeve 32 can be pulled downwards. The lower end of the operating sleeve 32 thus abuts against the stopper projection 22 formed on the body 2, whereby the downward movement of the operating sleeve 32 is prevented and thus the inspection mirror member or object mirror member 30 is held in this storing position. In order to bring the inspection mirror member or object mirror member 30 from the storing position to the using position, it is necessary only to pull the operating sleeve 32 by applying thereto a force slightly stronger than normal force. In this way, the rod end 34 fits in the annular groove 23, and as a result the inspection mirror member or object mirror member 30 is in the using position.

In this connection, on the post 33 may be formed a blind groove in lieu of said perforation 42 and on the rod end 34 of the rod 35 may be formed a spherical tip. In this way, the spherical tip can be disengaged from the annular groove 23 only by pulling upwardly the operating sleeve with a force stronger than normal, that is, without pressing the projected portion 47 as described in the foregoing. Besides, instead of forming the spherical tip on the rod end 34, the rod end 34 may be smoothly curved, for instance, formed into a U-shape or L-shape.

The ocular mirror member 31 is composed by conjoining a base plate 49 with a threaded portion 48 devised to set the base of the body 2 detachably therein and an ocular mirror holder 51 holding an ocular mirror by means of a ball joint 52. The upper end of said threaded portion 48 is formed in the manner of projecting upward over the surface of the base plate 49.

The threaded portion 48 formed in the base plate 49 can hold the body 2 in upright posture when the base of the body is set therein by screw-fitting in the screw-threaded portion 26 formed at the base end of the body 2. The base plate 49, as shown in FIG. 11, is formed to have its end portion with the threaded portion 48 gently curved so that the lower half of the body 2 can be firmly gripped without being disturbed by the edge of the base plate 49 at the time of a rotating operation or an axially sliding operation of the operating sleeve 32 by holding the body 2 with the hand. On the base plate 49 is provided a lower arm 54 which rises almost perpendicularly on said plate and then bends to extend almost horizontally in the direction of the end portion of the plate opposite to said curved end portion, said lower arm 54 being provided with a lower ball 53 formed on the fore end thereof.

On the ocular mirror holder 51 is formed an upper arm 57 which rises almost perpendicularly on said holder and then bends to extend almost parallel to the ocular mirror 50, said upper arm 57 being provided with an upper ball 56 formed on the fore end thereof. The ocular mirror 50 consists of a concave mirror capable of magnifying the object to be inspected so that the minutest details may be well inspected.

The ball joint 52 is composed by disposing face to face a pair of supports 58 having a spherical hollow, respectively, for accomodating a lower ball 53 and an upper ball 56 in each end in slidable fashion and then conjoining both supports 58 at their central part. The construction of joining the supports is such that on one support is rotatably positioned a screw bolt 59 which extends from said support toward the other support, on the other support is provided a tapped hole to which the screw bolt 59 is screw fitted, and the screw bolt 59 is made to be driven by a dial 60 fitted on the circumference of the screw bolt 59 in the interstice of both supports. In this way, the interstice of both supports can be widened or narrowed by turning the dial 60, and accordingly the lower ball 53 and the upper ball 56 accomodated in between both supports can be compressed between both supports under an appropriate pressure. The ocular mirror holder 51, therefore, is allowed to move freely in every direction within the sphere free from colliding with the body 2 and the base plate 49 to thereby change the position as well as posture thereof, and further is allowed to come to a standstill at an optional position or in an optional posture.

The means suitably utilized herein for holding the ocular mirror holder 51 on the base plate 49 include the above described ball joint 52 and other means, for instance, such as a flexible tube for use in a desk-lamp type lighting equipment, a rubber tube with lead wire inserted therein or the like.

Figure 13:
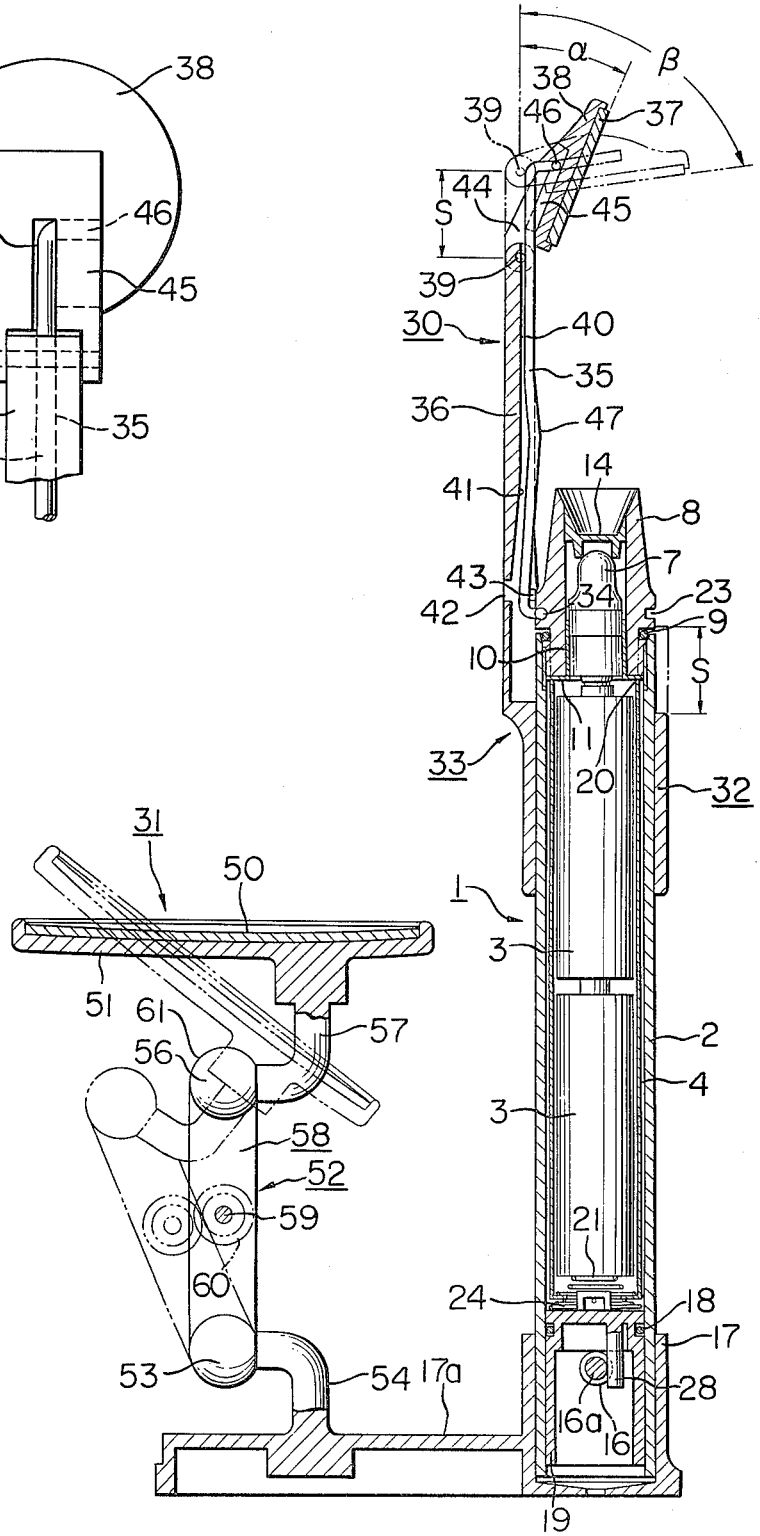
FIG. 13 is a vertical sectional view illustrating another embodiment of the inspection device for organic cavities to which the above mentioned second embodiment of the illumination device according to the present invention is applied.

In FIG. 13 there is shown another embodiment of the inspection device for organic cavities using the illumination device in connection with the above second embodiment of the present invention. This inspection device is substantially identical with those shown in FIGS. 10–12. The differences therebetween are as follows. In the case of the above mentioned inspection device the base plate 49 is designed to be detachable from the body 2 of the illumination device 1, but in the case of the inspection device referred to herein the horizontal portion **17*a* which is integral with the operation ring 17 constitutes the base plate, whereby it is made impossible to remove the base plate 17*a* from the body 2 of the illumination device 1. Further, the construction for joining a pair of supports 58 of the ball joint 52 is that on one support is fastened a screw bolt 59 with a head which extends from said support to the other, and the screw bolt 59 is designed to be driven by the head 60**.

Both inspection devices as described above are substantially identical in function. In addition, those devices are substantially identical in function with the inspection device for organic cavities disclosed in the U.S. application Ser. No. 848,616 filed Nov. 4, 1977 by the inventor of this invention. The manner of use in which the illumination device 1 is combined with the inspection mirror member 30 or ocular mirror member 31 above is fully described in that application.

Although particular preferred embodiments of the invention have been disclosed in detail for illustrative purpose, it will be recognized that variations or modifications of the above disclosed apparatuses, including the arrangement of parts, lie within the scope of the present invention.

I claim:

1. A lighting device, comprising:

an elongated tubular body having a lamp mounted on the upper longitudinal end thereof, said lamp having a pair of terminals;

an elongated, hollow, inner, battery-holding member disposed inside of said tubular body and extending lengthwise therein from adjacent said lamp toward the lower longitudinal end of said body, said battery-holding member being longitudinally movable inside said tubular body, said battery-holding member comprising an electrically conductive pathway extending from the upper end thereof to close to the lower end thereof with the upper end of said electrically conductive pathway being adapted to electrically contact one of the terminals of said lamp;

battery means longitudinally slidably disposed inside said battery-holding member, said battery means having a first electrode at its upper end adapted to contact the other of the terminals of said lamp, said battery means having a second electrode at its lower end;

electrically conductive resilient biasing means disposed in said battery-holding member for biasing said battery means upwardly relative to said battery-holding member to hold said first electrode in engagement with said other terminal of said lamp and to space the upper end of said battery-holding member from said one terminal of said lamp, said biasing means also electrically connecting said second electrode to said electrically conductive pathway of said battey-holding member; and switching means mounted on said body for movement relative thereto, said switching means being coupled with said battery-holding member so that movement of said switching means relative to said body overcomes said biasing means and displaces said battery-holding member longitudinally upwardly in said body and longitudinally upwardly relative to said battery means whereby an electrical connection between the upper end of said electrically conductive pathway of said battery-holding member and said one terminal of said lamp can be made or broken and said lamp can thereby be energized or deenergized by movement of said switching means relative to said body.

2. A lighting device according to claim 1 including a cover detachably mounted on said tubular body and covering said lamp; said cover, said body and said switching means being made of waterproof material; first sealing means mounted between said cover and said tubular body for sealing said body against entrance of water thereinto and second sealing means mounted between said switching means and said body for sealing said body against entrance of water thereinto.

3. A lighting device according to claim 1 in which said switching means is mounted adjacent to the lower end of said battery-holding member, said switching means being movable axially of said body and means for releasably holding said switching means in a position in which said lamp is energized.

4. A lighting device according to claim 3 including second resilient biasing means disposed between said switching means and the lower end of said battery-holding member.

5. A lighting device according to claim 4 wherein said switching means has an upwardly extending stop member projecting upwardly therefrom toward the lower end of said battery-holding member, said stop member engaging the upper end of said second resilient biasing means to maintain constant the length of said second resilient biasing means between the lower end of said battery-holding member and the upper end of said switching means.

6. A lighting device according to claim 1 wherein said switching means is disposed inside of said body adjacent to the lower end thereof and below the lower end of said battery-holding member, said switching means being rotatable relative to said body and also being longitudinally movable inside said body.

7. A lighting device according to claim 2 wherein said cover, said body and said switching means are made of electrically non-conductive material.

8. A lighting device according to claim 3 wherein said switching means has at least one lateral projection which extends through a circumferentially elongated slot in said body, said slot being circumferentially elongated to permit rotation of said switching means, said slot also having an axially inclined portion so that rotation of said body relative to said switching means will effect longitudinal movement of said switching means in said body.

9. A lighting device according to claim 8 in which said slot has a substantially circumferentially extending stop portion at the upper end of said axially inclined portion of said slot for stopping movement of said projection along said slot and thereby stopping relative rotation of said switching means with respect to said body to releasably hold said switching means in a position in which said lamp is energized.

10. A lighting device according to claim 8 or claim 9 including an annulus rotatably sleeved on said body and connected to said projection for effecting relative rotation between said body and said switching means.

11. A lighting device according to claim 4 wherein the biasing force of said second resilient biasing means is greater than the biasing force of said first resilient biasing means.

12. A lighting device according to claim 9 wherein the biasing force of said second resilient biasing means is greater than the biasing force of said first resilient biasing means and is sufficient to insure movement of said battery-holding member when said switching means is moved longitudinally in a direction to energize the lamp so that when the projection reaches a position somewhat short of said stop portion the battery-holding member is electrically connected to said one terminal of said lamp and the electrical connection is maintained when the projection moves into said stop portion.

13. A lighting device according to claim 1 wherein said battery-holding member is a cylinder made of electrically conductive material so that said electrically conductive pathway is defined by said cylindrical battery-holding member, said one terminal of said lamp being an annular terminal engageable with the annular upper end of said battery-holding member.

14. A lighting device according to claim 13 wherein the upper end of said battery-holding member and said annular terminal are rigid and do not substantially deform when they are engaged or disengaged from each other.

15. A lighting device, comprising:

an elongated tubular body made of electrically non-conductive, waterproof material;

a cover made of electrically non-conductive, waterproof material, said cover having a tubular side wall made of opaque material and a transparent central portion adjacent to its upper end, said side wall having a lower portion removably received in the upper end of said tubular body and sealed thereto so that said tubular body is closed by said cover;

a lamp disposed inside said tubular side wall of said cover and beneath said transparent central portion, said lamp having a first centrally located terminal and a second annular terminal, both of said terminals being located at the lower end of said lamp;

an electrically conductive, battery-holding, inner cylinder disposed within said body for axial sliding movement therein and extending longitudinally therein from adjacent the lower end of said cover to a location close to the lower end of said body, the annular upper end of said inner cylinder being adapted for electrical contact with said annular terminal of said lamp, the lower end of said cylinder having transversely extending bottom wall means;

battery means axially slidably disposed inside said inner cylinder, said battery means having a first centrally located electrode at the upper end thereof and adapted to electrically contact said first centrally located terminal of said lamp, said battery means having a second centrally located electrode at the lower end thereof;

an electrically conductive, first coil spring disposed between and contacting said second electrode at the lower end of said battery means and said bottom wall means of said inner cylinder to provide an electrical connection therebetween and to urge said battery means upwardly relative to said inner cylinder to hold said first electrode in contact with said first terminal and to space the upper end of said inner cylinder from said annular terminal of said lamp;

a cylindrical switching member made of electrically non-conductive, waterproof material, said switching member being disposed inside said body adjacent to the lower end of said body and being sealed thereto, said switching member being movable circumferentially and axially inside said body;

a second coil spring disposed between and bearing against the upper side of said switching member and the lower side of the bottom wall means of said inner cylinder;

said body having, adjacent its lower end, a pair of corresponding, oppositely disposed, circumferentially elongated slots each having an axially inclined portion and a stop portion at the upper end of said axially inclined portion;

a rod extending diametrically through said cylindrical switching member and having end portions received in said slots for movement therealong; and an annular sleeve on the exterior of said body adjacent its lower end and connected to said end portions of said rod so that relative rotation between said sleeve and said body will be effective to move said switching member circumferentially and axially relative to said body and thereby move said inner cylinder between a position in which the annular upper end thereof electrically contacts said annular terminal and a position in which the annular upper end thereof is axially spaced from said annular terminal.

* * * * *